US007708266B2

(12) United States Patent
Hirose

(10) Patent No.: US 7,708,266 B2
(45) Date of Patent: May 4, 2010

(54) SHEET FEEDER AND IMAGE FORMING APPARATUS

(75) Inventor: Atsuo Hirose, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/947,142

(22) Filed: Nov. 29, 2007

(65) Prior Publication Data

US 2008/0128973 A1 Jun. 5, 2008

(30) Foreign Application Priority Data

Nov. 30, 2006 (JP) ..... 2006-323918

(51) Int. Cl.
*B65H 3/06* (2006.01)

(52) U.S. Cl. ..... 271/118; 271/117; 271/121

(58) Field of Classification Search ..... 271/117, 271/118, 121

See application file for complete search history.

(56) References Cited

U.S. PATENT DOCUMENTS 5,364,195 A 11/1994 Kanemitsu et al.
5,501,444 A * 3/1996 Yukimachi et al. ..... 271/127
5,927,703 A 7/1999 Endo
2005/0263954 A1* 12/2005 Worley et al. ..... 271/114
2006/0049572 A1* 3/2006 Miyazawa ..... 271/121
2006/0180987 A1* 8/2006 Hattori ..... 271/117
2006/0267269 A1* 11/2006 Yano et al. ..... 271/127

FOREIGN PATENT DOCUMENTS

JP 01288539 A * 11/1989
JP 05-186104 7/1993
JP 06-072581 3/1994
JP 09-235033 9/1997
JP 2006-175878 7/2006

* cited by examiner

*Primary Examiner*—Patrick H Mackey
*Assistant Examiner*—Luis Gonzalez
(74) *Attorney, Agent, or Firm*—Banner & Witcoff, Ltd

(57) ABSTRACT

A sheet feeder comprising: a feed roller which feeds sheet by rotating in contact with the sheet; a separation roller which is disposed at a downstream side of a sheet feeding direction; a supporting member which supports the feed roller and the separation roller, the supporting member is supported so as to be swingable around the rotation axis of the separation roller; a drive source which drives the supporting member so as to swing; an arm pivot which is disposed between the drive source and the supporting member; a first arm which is disposed at a side of the drive source; and a second arm which is disposed at a side of the supporting member, the second arm is able to be separated from the first arm; wherein the first arm and the second arm are integrally swung around the arm pivot by the drive source, thereby the supporting member swinging.

7 Claims, 15 Drawing Sheets

68
267
217
207
203b
204b
240
102
241
203a
61
204a
267a
61a

-PRIOR ART-

SHEET FEEDER AND IMAGE FORMING APPARATUS

CROSS REFERENCE TO RELATED APPLICATION

The present application claims priority from Japanese Patent Application No. 2006-323918, which was filed on Nov. 30, 2006, the disclosure of which is herein incorporated by reference in its entirety.

TECHNICAL FIELD

The present invention relates to a sheet feeder for feeding sheets (including the concept of documents, etc.) and an image forming apparatus in various types of image processing apparatuses such as a printer, a copier, a document reading apparatus, etc.

BACKGROUND

Conventionally, as a so-called twin-roller type sheet feeder in which a feed roller and a separation roller are integrally composed, there is such a type as shown in, for example, Patent Document 1. As shown in FIG. 15, the type has a spring clutch unit 107 based on a twisted coil spring 113 which is twined on the input hub 111 and the output hub 112, and the spring clutch unit 107 is fixed to the rotating shaft 104 of a feed roller 101 by setting the output hub 111 by means of a screw 114. The type has a delivery roller 102 which is caused to go up and down by swinging the frame 106 with the delivery roller 102 retained by the output hub 112.

[Patent Document 1] Japanese Published Unexamined Patent Application No. H6-72581

SUMMARY

It is necessary that the delivery roller 102 and the feed roller 101 be replaced since these rollers are worn through long period of use. However, in this case, since the spring clutch unit 107 is fixed to the rotating shaft 104 of the feed roller 101, it is impossible that the delivery roller 102 and the feed roller 101 are smoothly replaced.

According to an aspect of the invention, there is provided a sheet feeder comprising: a feed roller which feeds sheet by rotating in contact with the sheet; a separation roller which is disposed at a downstream side of a sheet feeding direction; a supporting member which supports the feed roller and the separation roller, the supporting member is supported so as to be swingable around the rotation axis of the separation roller; a drive source which drives the supporting member so as to swing; an arm pivot which is disposed between the drive source and the supporting member; a first arm which is disposed at a side of the drive source; and a second arm which is disposed at a side of the supporting member, the second arm is able to be separated from the first arm; wherein the first arm and the second arm are integrally swung around the arm pivot by the drive source, thereby the supporting member swinging.

According to the first aspect of the invention, since the arm is composed so that it can be separated from the first arm and the second arm, it is possible to replace the feed roller and the separation roller without removing the first arm from the arm pivot. Therefore, replacement of the rollers can be easily carried out, and the time required for the replacement can be shortened.

BRIEF DESCRIPTION OF THE DRAWINGS

Illustrative aspects of the invention will be described in detail with reference to the following figures wherein.

DETAILED DESCRIPTION OF THE PREFERRED ILLUSTRATIVE ASPECTS

First Illustrative Aspect

1. Entire Structure

Figure 1:
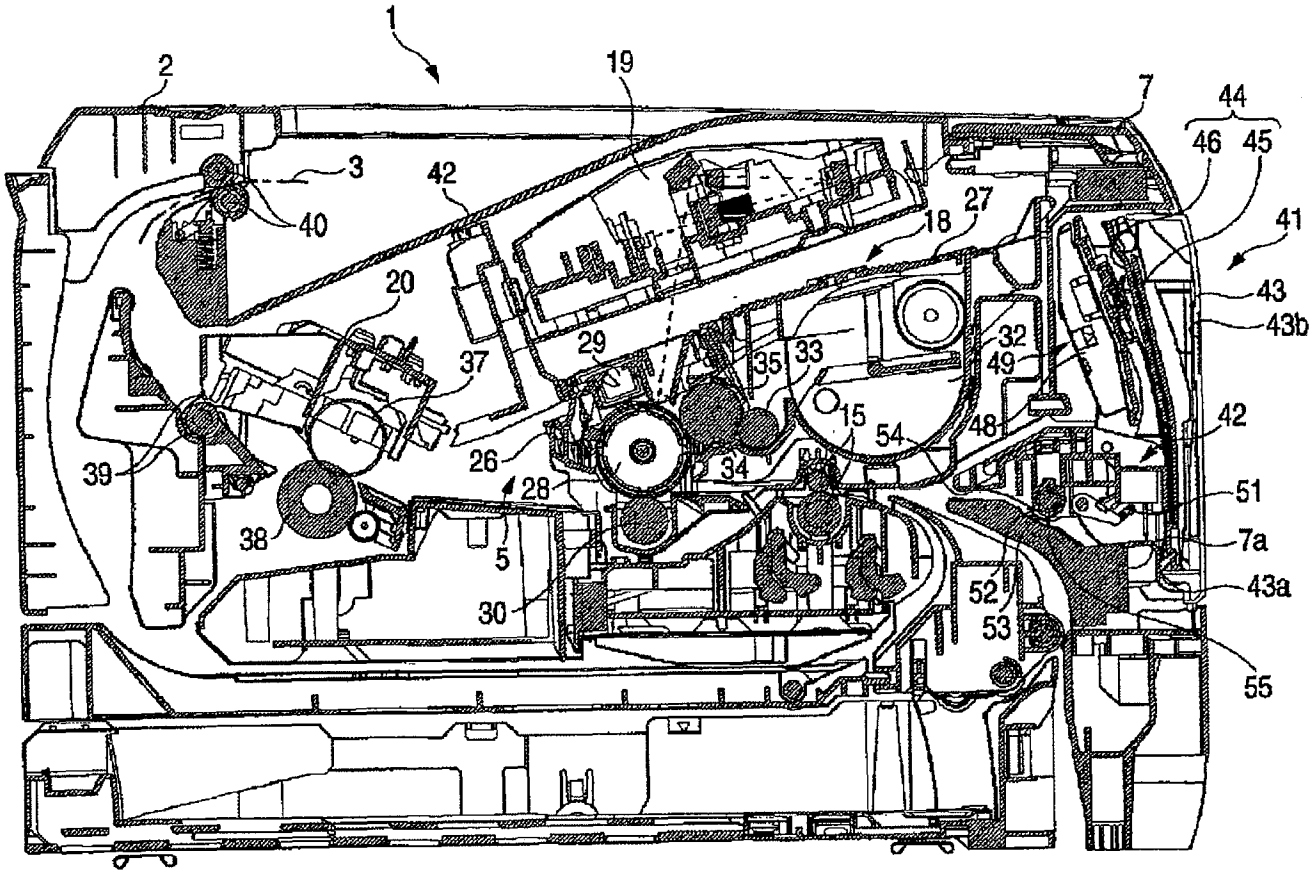
FIG. 1 is a side sectional view showing the major parts of a laser printer according to first illustrative aspect of the present invention.

A description is given of first illustrative aspect of the present invention with reference to FIGS. 1 through 6. FIG. 1 is a side sectional view showing the major parts of a laser printer 1 as an image forming apparatus according to the present invention. The laser printer 1 comprises an image-forming portion 5 to form images on a sheet 3 being a fed recording sheet of paper in the main body casing 2.

(1) Main Body Casing

The main body casing 2 comprises a front cover 7. Also, in the following description, it is assumed that, in the laser printer 1 and a process cartridge 18 (including a development cartridge 27 described later), the side at which the front cover 7 is mounted is the "front side," and the side opposite thereto is the "rear side." In addition, it is assumed that the right side when being observed from the front side of the laser 1 (that is, the paper far side) is the "right side," and the side opposite thereto (that is, the paper near side) is the "left side."

(2) Image Forming Portion

The image-forming portion 5 comprises a scanner portion 19, a process cartridge 18, and a fixing portion 20, etc.

(a) Scanner Portion

The scanner portion 19 is provided on the upper part in the main body casing 2. A laser beam emitted from a laser light source and based on image data is irradiated on the surface of a photosensitive drum 28 described later, of the process cartridge 18 through high-speed scanning as shown by broken lines in FIG. 1.

(b) Process Cartridge

The process cartridge 18 is mounted downward of the scanner portion 19 detachably with respect to the main body casing 2. The process cartridge 18 comprises a drum cartridge 26 and a development cartridge 27 detachably mounted with respect to the drum cartridge 26.

The drum cartridge 26 has the development cartridge 27 at its front side and comprises the photosensitive drum 28, a scorotron type electrifier 29, and a transfer roller 30 at its rear side.

The development cartridge 27 comprises a toner accommodation chamber 32 in which toner is accommodated, a toner feed roller 33, a development roller 34, and a thickness restricting blade 35.

Toner in the toner accommodation chamber 32 is discharged toward the toner feed roller 33, and is fed to the development roller 34 by rotation of the toner feed roller 33. The toner fed onto the development roller 34 invades between the thickness restricting blade 35 and the development roller 34 in accordance with rotation of the development roller 34, and the toner is carried onto the development roller 34 as a thin film of a fixed thickness.

After the scorotron type electrifier 29 uniformly positively electrifies the surface of the photosensitive drum 28, the surface of the photosensitive drum 28 is exposed by high-speed scanning of a laser beam emitted from the scanner portion 19, and n electrostatic latent image corresponding to an image to be formed on a sheet 3 is formed on the surface of the photosensitive drum 28.

Next, positively electrified toner carried on the development roller 34 is fed to the exposed portion, the potential of which is lowered by being exposed by a laser beam, of the surface of the uniformly positively electrified photosensitive drum 28, whereby the electrostatic latent image on the photosensitive drum 28 is made into a visible image, and a toner image by reverse development is carried on the surface of the photosensitive drum 28.

After that, the toner image carried on the surface of the photosensitive drum 28 is transferred onto a sheet 3 by transfer bias applied onto the transfer roller 30 while the sheet 3 conveyed by the registration roller 15 passes through the transfer position between the photosensitive drum 28 and the transfer roller 30. The sheet 3 on which the toner image was transferred is conveyed to the fixing portion 20.

(c) Fixing Portion

The fixing portion 20 is provided at the rear side of the process cartridge 18, and the fixing portion 20 comprises a heating roller 37, a compression roller 38 and a transfer roller 39.

The toner transferred onto the sheet 3 is melted by heat while it passes through the heating roller 37 and the compression roller 38 and the toner is adhered to and fixed at the sheet 3. The sheet 3 is conveyed toward the discharge roller 40 by the conveying roller 39. After that, it is discharged onto a sheet discharging tray 42 by the discharge roller 40.

2. Multi-Purpose Mechanism

Figure 2:
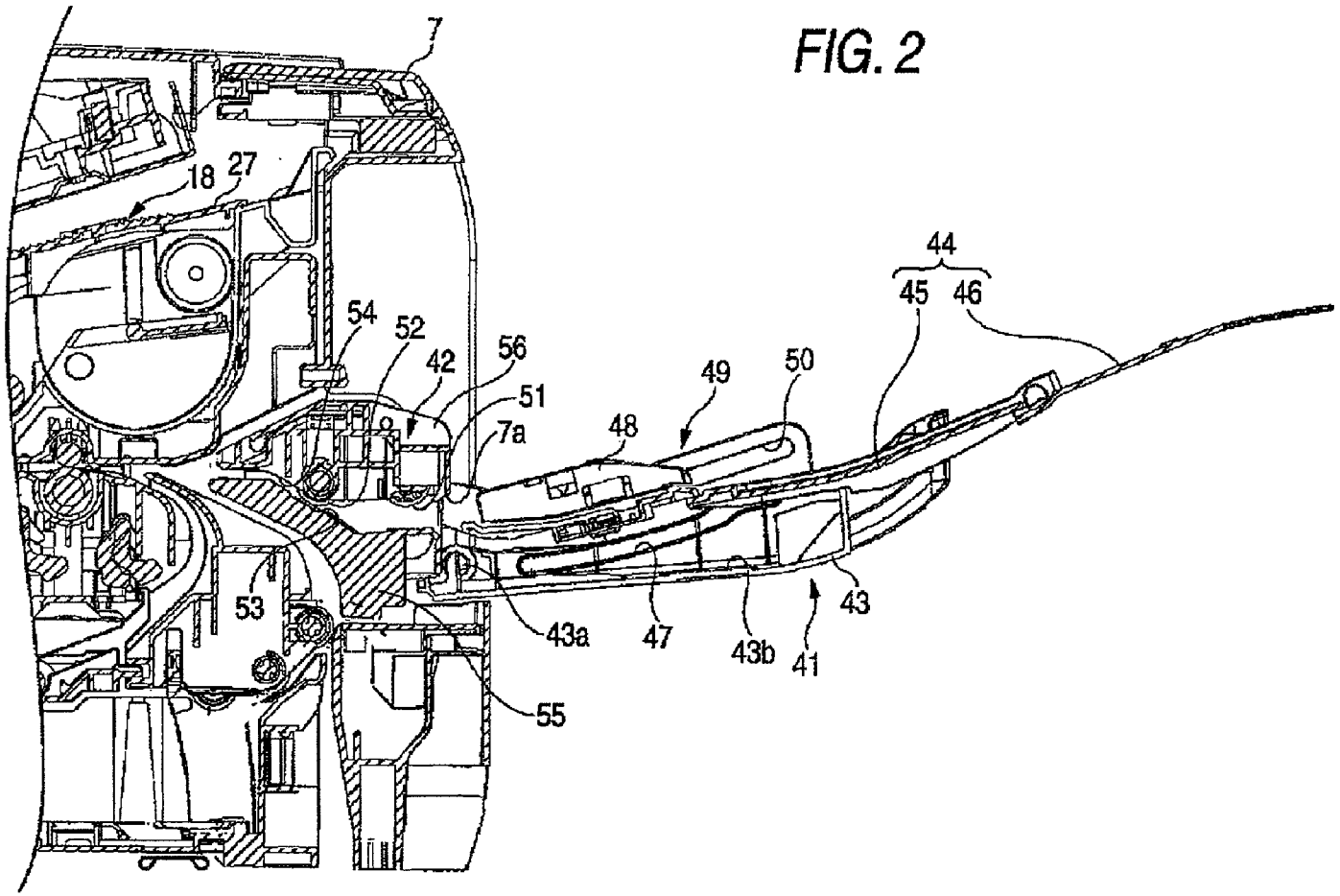
FIG. 2 is a side sectional view showing the major parts of a laser printer with the MP tray opened.

FIG. 2 is a sectional view of the major parts, showing a state where the multi-purpose tray (hereinafter referred to as MP tray 41) is opened. The laser printer 1 comprises a multi-purpose mechanism (manual sheet feeding mechanism operating as a sheet feeder) for conveying sheets 3 from the front side of the laser printer 1 to the transfer position by manual feeding. The multi-purpose mechanism includes an MP tray 41 and a multi-purpose sheet feeding mechanism portion (hereinafter referred to as MP sheet feeding mechanism portion 42) for feeding sheets 3 onto the MP tray 41.

(1) MP Tray

A rectangular opening 7*a* is penetrated and formed in the front side cover 7, and the MP tray 41 is provided so as to cover the opening 7*a*. In detail, the MP tray 41 comprises a cover portion 43, which is made into the front side wall of the main body casing 2, and a tray portion 44 on which sheets to be manually fed are placed. The cover portion 43 is provided, as shown in FIG. 2, so that the lower end portion side is axially supported by means of a cover turning shaft 43*a* with respect to the main body casing 2, the cover portion 44 is made openable and closable centering around the cover turning shaft 43*a*, and the cover portion 44 is locked in a state where an inner side portion 43*b* is turned upward. And, the tray 44 is provided on the inner side portion 43*b*.

The tray portion 44 comprises a first tray plate 45 disposed on the inner side portion 43*b* of the cover portion 43 and an second tray plate 46 rotatably and axially supported at the front end part of the first tray 45. The first tray plate 45 is located at the position where the first tray plate 45 can be accommodated in the inner side portion 43*b* of the cover portion 43 in a state where the MP tray 41 is closed (Refer to FIG. 1). And the first tray plate 45 is provided so as to slide the position where the front end portion protrudes forward of the cover portion 43 along a guide groove 47 when the MP tray 41 is opened (Refer to FIG. 2).

The second tray plate 46 is rotatably axially supported at the front end portion of the first tray 45. The second tray plate 46 is rotatable between the position (refer to FIG. 1) where it is stacked on the upper surface of the first tray plate 45, and the position (Refer to FIG. 2) where it is expanded forward of the first tray plate 45. Also, in the tray portion 44, the cover turning shaft 43*a* side (the leading edge side of insertion of the sheets 3) is tilted downward in a state where the MP tray 41 is opened, as shown in FIG. 2.

Also, the MP tray 41 comprises a guide mechanism 49 having a pair of guide ribs 48 and 48 (only the left side rib is illustrated in FIG. 1 and FIG. 2). When the MP tray 41 is opened, the pair of guide ribs 48 and 48 guides conveyance of sheets 3 loaded in the tray portion 44 with both ends thereof in their width direction nipped therebetween. The pair of guide ribs 48 and 48 is made slideable in the directions approaching each other and parting from each other, wherein the MP tray 41 is able to stack sheets 3 of optional sizes in layers.

The guide mechanism 49 is positioned rearward (in an upper space of the MP sheet feeding mechanism 42) of the upper end portion of the folded tray portion 44 in a state where the MP tray 41 is closed (Refer to FIG. 1). The guide mechanism 49 is slideable along a guide groove 50 when the MP tray 41 is opened (Refer to FIG. 2), and the guide mechanism 49 is positioned at the rear side of the first tray 45.

(2) MP Sheet Feeding Mechanism Portion

As shown in FIG. 2, the MP sheet feeding mechanism portion 42 comprises a feed roller 51, a separation roller 52 disposed at a further far side of the sheet feeding inlet side than the feed roller 51, and a separation pad 53 pressed in a state opposed to the separation roller 52. In a state where the separation roller 52 and the separation pad 53 are opposed to and are brought into contact with each other, the separation pad 53 is pressed toward the separation roller 53 by a pressing force of an pressing member (not illustrated). That is, the multi-purpose mechanism according to the first illustrative aspect is a twin-roller system consisting of the feed roller 51 and the separation roller 52, the feed roller 51 is disposed at the MP tray 41 side and the separation roller 52 is disposed rearward thereof.

The uppermost sheet 3 stacked on the MP tray 41 is fed by rotation of the feed roller 51 and is nipped between the separation roller 52 and the separation pad 53. After that, sheets 3 are fed one by one by cooperation thereof. Fed sheets 3 are conveyed to the registration roller 15 through a conveying path 54.

In further detail, a roller unit, which axially supports the feed roller 51 and the separation roller 52 with both the rollers exposed downward, is provided. The feed roller 51 vertically moves in the downward inclination space as described below.

(3) Vertical Drive Mechanism of the Feed Roller

Figure 3:
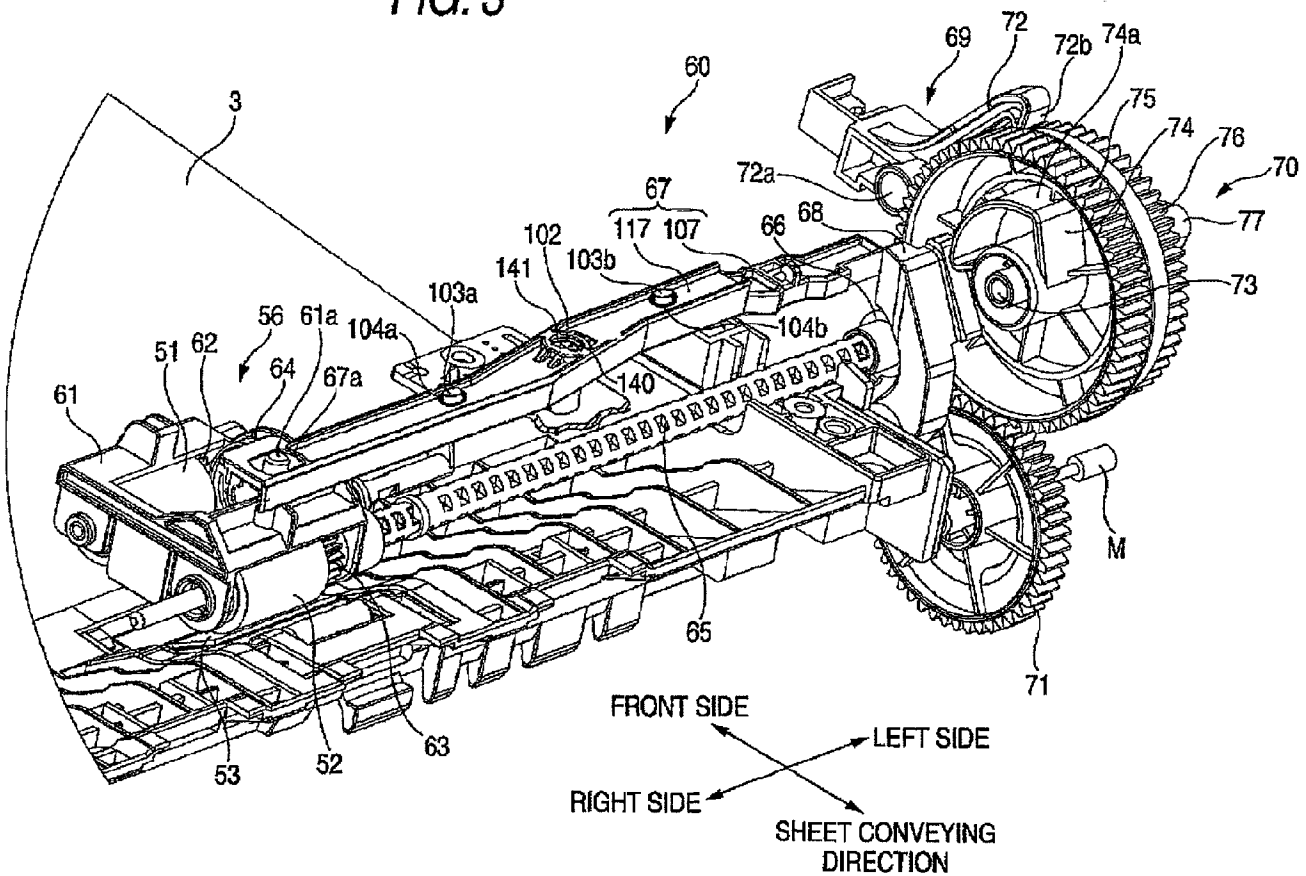
FIG. 3 is a perspective view showing a vertical drive mechanism of a feed roller (in a state where the feed roller is located at its elevated position)
Figure 4:
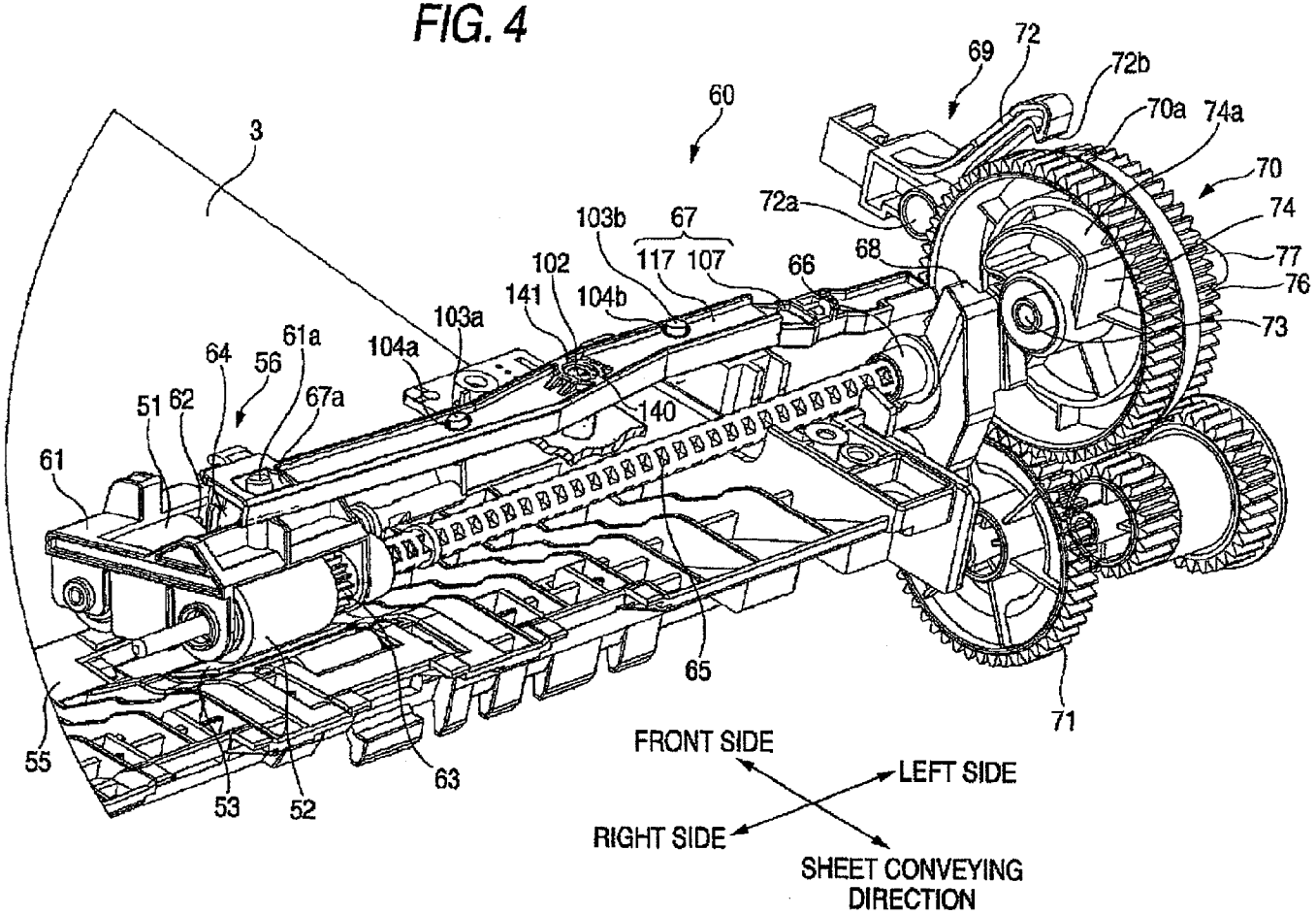
FIG. 4 is a perspective view showing a vertical drive mechanism of a feed roller (in a state where the feed roller is located at its descended position)

FIG. 3 and FIG. 4 are perspective views showing the vertical drive mechanism 60 of the feed roller 51. In these drawings, the paper left upper side is the front side of the laser printer 1, the paper right lower side is the conveying direction of the sheets 3, the paper right side is the left side of the laser printer 1, and the paper left side is the right side of the laser printer 1, respectively.

As shown in FIG. 3 and FIG. 4, the roller unit 56 comprises the feed roller 51 and separation roller 52. The feed roller 51 and separation roller 52 are provided on a bearing member 61 that is a common rotatably supporting member thereof. In detail, in the feed roller 51, a gear 62 is integrally provided coaxially with the feed roller 51 at the sideward thereof (the left side, that is, the paper right side in the same drawings), and the feed roller 51 and the gear 62 are axially supported rotatably at the front end side of the bearing member 61. On the other hand, a gear 63 is integrally provided coaxially with the separation roller 52 at the sideward thereof (the left side, that is, the paper right side in the same drawings), and the separation roller 52 and the gear 63 are axially supported rotatably at the rear end side of the bearing member 61. And, the gears 62 and 63 are coupled to each other by means of an intermediate gear 64.

At the further left side of the separation roller 52, a rotation axial member 65 extending in the left and right direction is disposed coaxially with the separation roller 52. The rotation shaft of the separation roller 52 is fixed at the right end portion of the rotation shaft body 65, and a separation roller drive gear 66 being a part of the drive source is fixed at the left end portion. Therefore, by the separation roller drive gear 66 being given a drive force from a drive motor M, the separation roller 52 rotates. In line therewith, the feed roller 51 dependently rotates. In addition, the feed roller 51 side of the roller unit 56 is swingable centering around the separation roller 52. A drive motor M gives a drive force not only the separation roller drive gear 66 but also other gears.

Also, an arm 67 consisting of the first arm 107 and the second arm 117 is disposed upward of the rotation axial member 65 so as to go along the left and right direction of the laser printer 1. The first arm 107 has two arm bosses 103*a* and 103*b* in the axial direction of the separation roller 52. And, a rotation center boss 140 in which the arm pivot 102 inserts is disposed between these two arm bosses 103*a* and 103*b*. Further, an outward-opening resilient locking claw is provided at the distal end of the arm pivot 102, the rotation center boss 140 in which the arm pivot 102 inserts is composed so as not to come off from the arm pivot 102 by the upper end surface thereof being locked with the resilient locking claw.

Two arm holes 104*a* and 104*b* are provided in the second arm 117, and a rotation center hole 141 is provided between these two arm holes 104*a* and 104*b*.

The arm bosses 103*a* and 103*b* of the first arm 107 are fitted into the arm holes 104*a* and 104*b* of the second arm 117 (since the rotation center boss 104 is smaller than the rotation center hole 141, these bosses are inserted into the holes in an idle state), wherein these components can be positioned to each other. Therefore, the first arm 107 and the second arm 117 are made integral with each other, wherein they integrally swing centering around the arm pivot 102. Also, the arm pivot 102 is a boss attached to the sheet feeder main body.

Although not being illustrated, a part of the cover of the sheet feeder, which covers the vertical drive mechanism 60 of the feed roller 51, is detachably provided so as to be opposed to the upper surface of the arm 67, whereby the second arm 117 is prevented from being floated upward so that it is not disengaged from the first arm 107.

And, a through-hole 67*a* is formed at one end portion side (the right end portion side) of the second arm 117 and penetrates the second arm in the vertical direction. A protrusion portion 61*a* protruding from the rear end side of the upper surface of the bearing member 61 is inserted into the through hole 67*a*.

And, rearward of the other end portion side (the left end portion side) of the first arm 107, the pressing member 68 is provided so that the upper end portion thereof can tilt centering around the lower end portion thereof. And, as shown in FIG. 3, in a state where the upper end portion of the pressing member 68 tilts to the front side, the pressing member 68 is brought into contact with the left end portion of the arm 67 and locks the same by pressing it forward. At this time, since the right end portion of the arm 67 presses the protrusion portion 61*a* rearward, the feed roller 51 is located at an elevated position spaced from the upper surface of the sheet conveyance supporting member 55 for conveying and supporting the sheets 3.

On the other hand, as shown in FIG. 4, as the upper end portion of the pressing member 68 is tilted rearward, the pressing member 68 is spaced from the left end portion of the first arm 117, and the locking between them is released. Therefore, rearward pressing to the protrusion portion 61*a* by the right end portion of the second arm is released, wherein the feed roller 51 moves, by the self-weight of the feed roller 51, to a descending position where it can be brought into contact with the upper surface of the sheet conveyance supporting member 55, thus enabling feeding of sheets 3. Herein, in the first illustrative aspect, as shown in FIG. 2, the height of the feed roller 51 is flush with the height of the separation roller 52 when it is located at its elevated position, wherein the height is made into the uppermost position, and takes a lower position than the separation roller 52 in a state where the feed roller 51 is at its descended position.

A solenoid switch 69, a sector gear 70 and an input gear 71 that rotates upon receiving a drive force from a drive motor (not illustrated) are disposed in the vicinity of the pressing member 68.

The solenoid switch 69 functions as switching means that is turned on whenever it receives a sheet feeding commencement signal. A solenoid lever 72 is devised so that its roughly central portion 72*a* is rotatably supported and its front end portion descends downward by turning-on motions of the solenoid switch 69. Also, a locking claw 72*b* that is engaged with the locking protrusion 70*a* protruding from the outer circumferential surface of the sector gear 70 is provided at the rear end portion of the solenoid lever 72 integrally therewith.

The sector gear 70 comprises the first cam 74, the first notched teeth gear 75, the second notched teeth gear 76 and the second cam 77, which turn integrally with the same gear turning shaft 73.

(a) First Notched Teeth Gear

Figure 5:
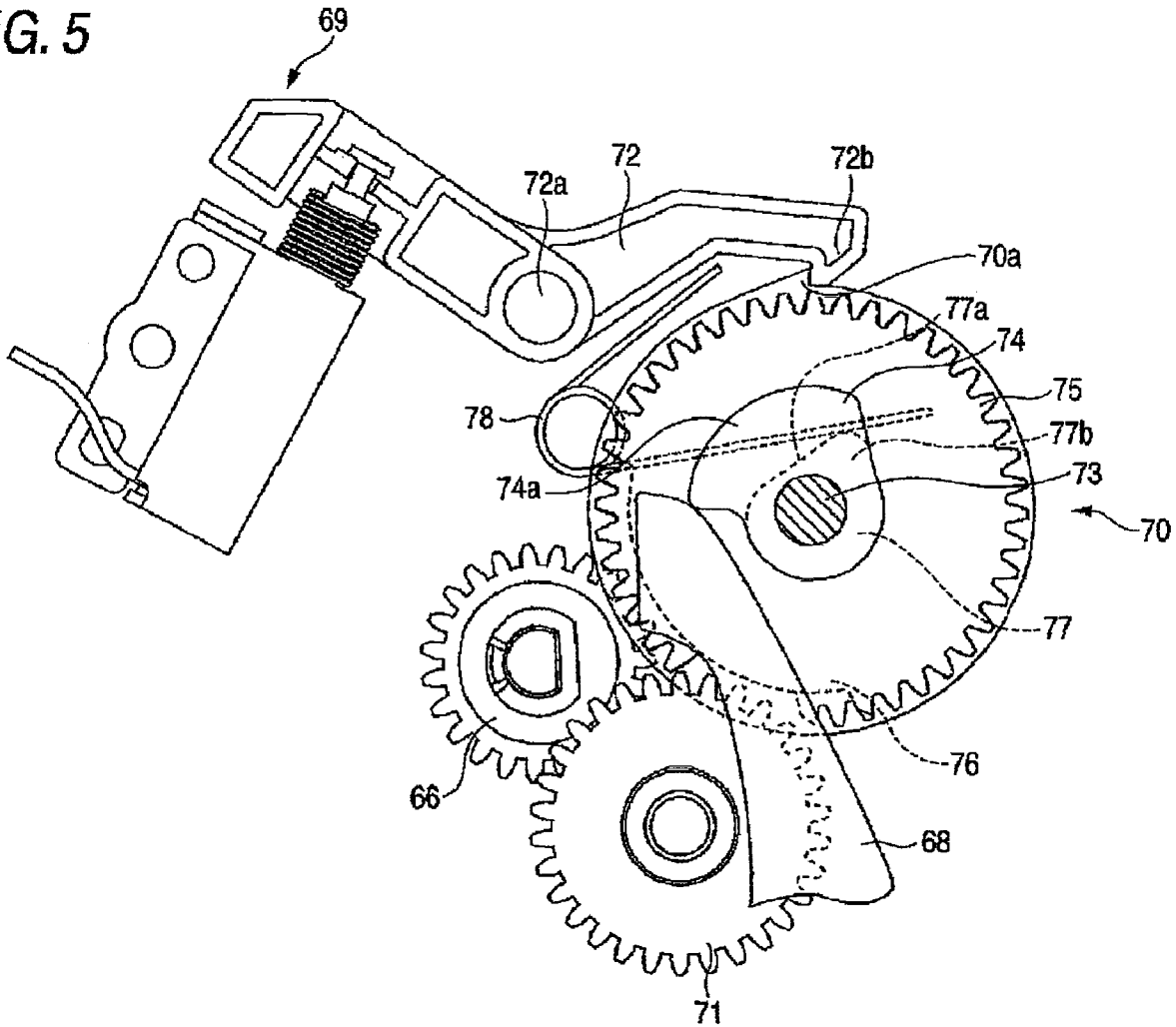
FIG. 5 is a left side view of the vertical drive mechanism in a state where the feed roller is located at its elevated position.

In further detail, as shown in FIG. 5, the first notched teeth gear 75 has partially consecutive notched teeth and is driven to turn by engagement with the input gear 71 when a drive force is inputted from the drive motor. Herein, when the locking claw 72*b* of the solenoid lever 72 is engaged with the locking protrusion 70*a* of the sector gear 70, the first notched teeth gear 75 is adjusted so that the notched teeth thereof face the input gear 71. At this time, the drive force from the input gear 71 is not transmitted to the sector gear 70 (Refer to FIG. 3 and FIG. 5).

(b) Second Notched Teeth Gear

The second notched teeth gear 76 is disposed at the left side (the paper right upper direction in FIG. 3 and FIG. 4, and the deep direction of paper in FIG. 5 and FIG. 6) of the first notched teeth gear 75. Also, roughly one-third the entire circumference of the second notched teeth gear 76 is consecutively notched. By the second notched teeth gear 76 being engaged with the feed roller drive gear 66, the second notched teeth gear functions to drive and rotate the separation roller 52. In addition, in the state shown in FIG. 3 and FIG. 5, the second notched teeth gear 76 gear is not engaged with the separation roller drive gear 66, wherein the separation roller idly rotates.

(c) Second Cam

The second cam 77 is disposed at the left side (the paper right upper direction in FIG. 3 and FIG. 4, and the paper far side in FIG. 5 and FIG. 6) of the second notched teeth gear 76. Also, the section, orthogonal to the gear rotation shaft 73, of the second cam 77 is roughly D-shaped as the entirety, and one end portion of the flat portion 77*a* is made into a protruded large-diameter portion 77*b*. In the state shown in FIG. 5, a sector spring 78 that is brought into contact with the large-diameter portion 77*b* of the second cam 77 in a pressed state is provided in the vicinity of the second cam 77. The sector spring 78 forcibly rotates the second cam 77 in the clockwise direction of paper in FIG. 6 when engagement by the solenoid lever 72 is released by turning-on of the solenoid switch 69, and the sector spring functions to turn the sector gear 70 to the position where the first notched teeth gear 75 is engaged with the input gear 71.

(d) First Cam

The first cam 74 is disposed at the right side (the left lower direction of FIG. 3 and FIG. 4, and the paper near side in FIG. 5 and FIG. 6) of the first notched teeth gear 75. Further, roughly one-third of the entire circumference of the first cam 74 is made into a consecutively large-diameter portion 74*a*, and the upper end portion of the pressing member 68 is disposed at the near side of the first cam 74. In the state shown in FIG. 4 and FIG. 6, the large-diameter portion 74*a* of the first cam 74 is bumped against the upper end portion of the pressing member 68, thereby locking the upper end portion at the front side position.

Next, a description is given of motions of the vertical drive mechanism 60 of the feed roller 51. The vertical drive mechanism 60 is located at its home position as shown in FIG. 3 and FIG. 5 before a sheet feeding commencement signal is given to the solenoid switch 69. The feed roller 51 is located at its elevated position spaced from the sheets 3, wherein the separation roller 52 idly turns with no drive force given.

Figure 6:
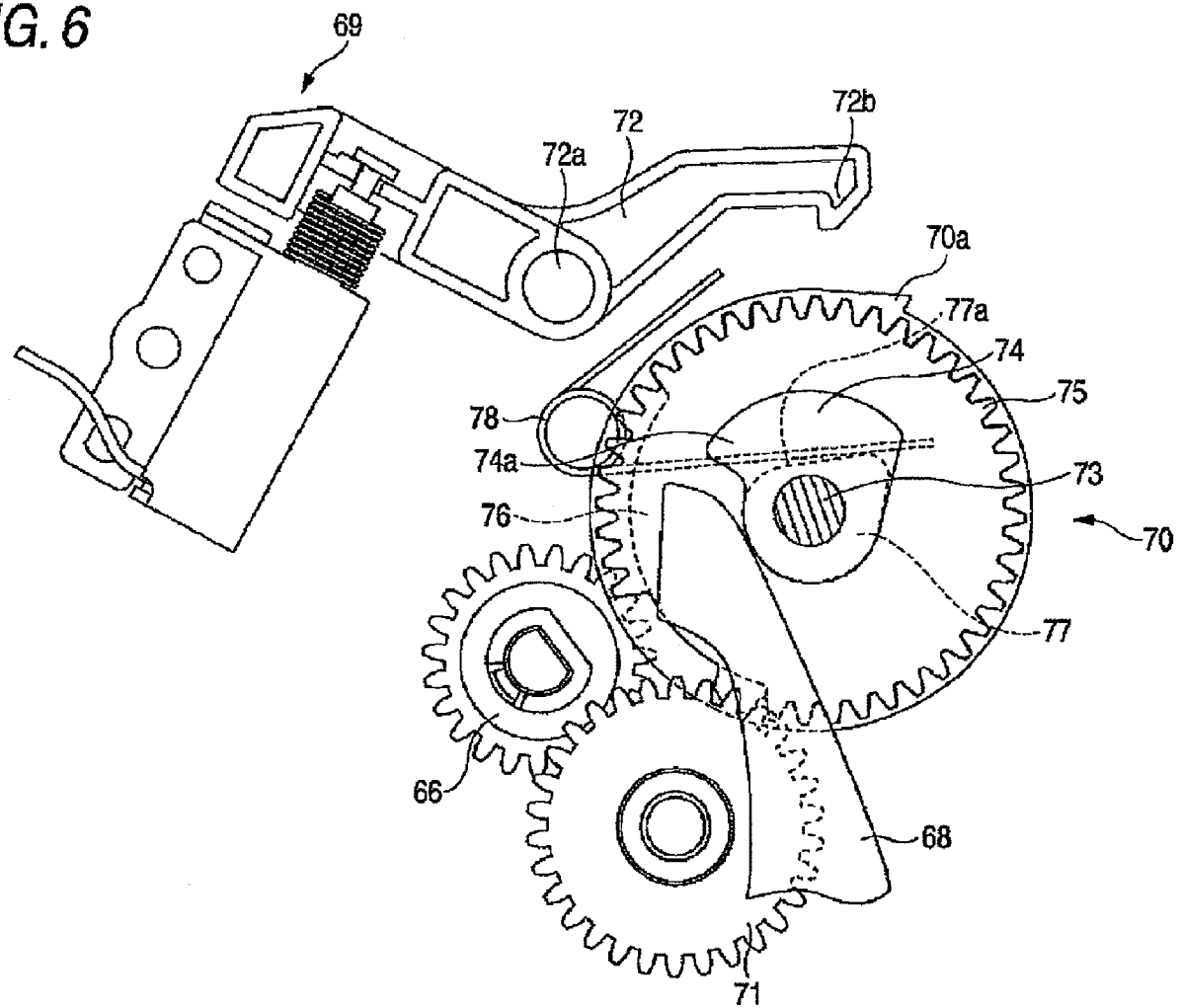
FIG. 6 a left side view of the vertical drive mechanism in a state where the feed roller is located at its descended position.

And, as a sheet feeding commencement signal is given to the solenoid switch 69, engagement of the locking protrusion 70*a* with the locking claw 72*b* is released as shown in FIG. 4 and FIG. 6, and the sector gear 78 turns to the position, at which the first notched teeth gear 75 and the input gear 71 are engaged with each other, by a pressing force of the sector spring 78. Therefore, the sector gear 70 is driven to turn in the clockwise direction. In addition, at this time, the large-diameter portion 74*a* of the first cam 74 is set back to release the locking of the pressing member 68, wherein due to the self-weight of the feed roller 51, the feed roller 51 moves to the descended position where the feed roller 51 is brought into contact with the upper surface of sheets 3 located on the upper surface of the partitioning member 55 (Refer to FIG. 4). However, since the second notched teeth gear 76 is not engaged with the separation roller drive gear 66 yet, the separation roller 52 can idly turn.

After that, since the sector gear 70 rotates, the second notched teeth gear 76 and the separation roller drive gear 66 are engaged with each other, wherein the separation roller 52 is driven to rotate. In line therewith, the feed roller 51 is driven. Accordingly, feeding of sheets 3 on the MP tray 41 is commenced, and the sheets 3 are separated one by one at the position where the separation roller 52 and the separation pad 53 are opposed to each other, and a separated sheet 3 passes through the conveying path 54.

And, as the sector gear 70 turns to the position where the large-diameter portion 74*a* of the first cam 74 is brought into contact with the upper end portion of the pressing member 68 again, the left end portion of the arm 67 is gradually pressed to the front side along the tapered surface of the rear side of the pressing member 68, and the feed roller 51 is reset to its elevated position. At this time, since the second notched teeth gear 76 is still engaged with the separation drive gear 66, the separation roller 52 and the feed roller 51 are being driven and rotated. Herein, the length in the circumferential direction of the large-diameter portion 74*a* of the first cam 74 is adjusted so that the timing at which the feed roller 51 is reset to its elevated position comes before the rear end of the separated sheet 3 goes through the opposed position. In particular, in the first illustrative aspect, the length is adjusted on the basis of the length (for example, the short side length of a postcard) in the conveying direction of sheets of the minimum size, which can be used in the present laser printer 1.

Second Illustrative Aspect

Figure 7:
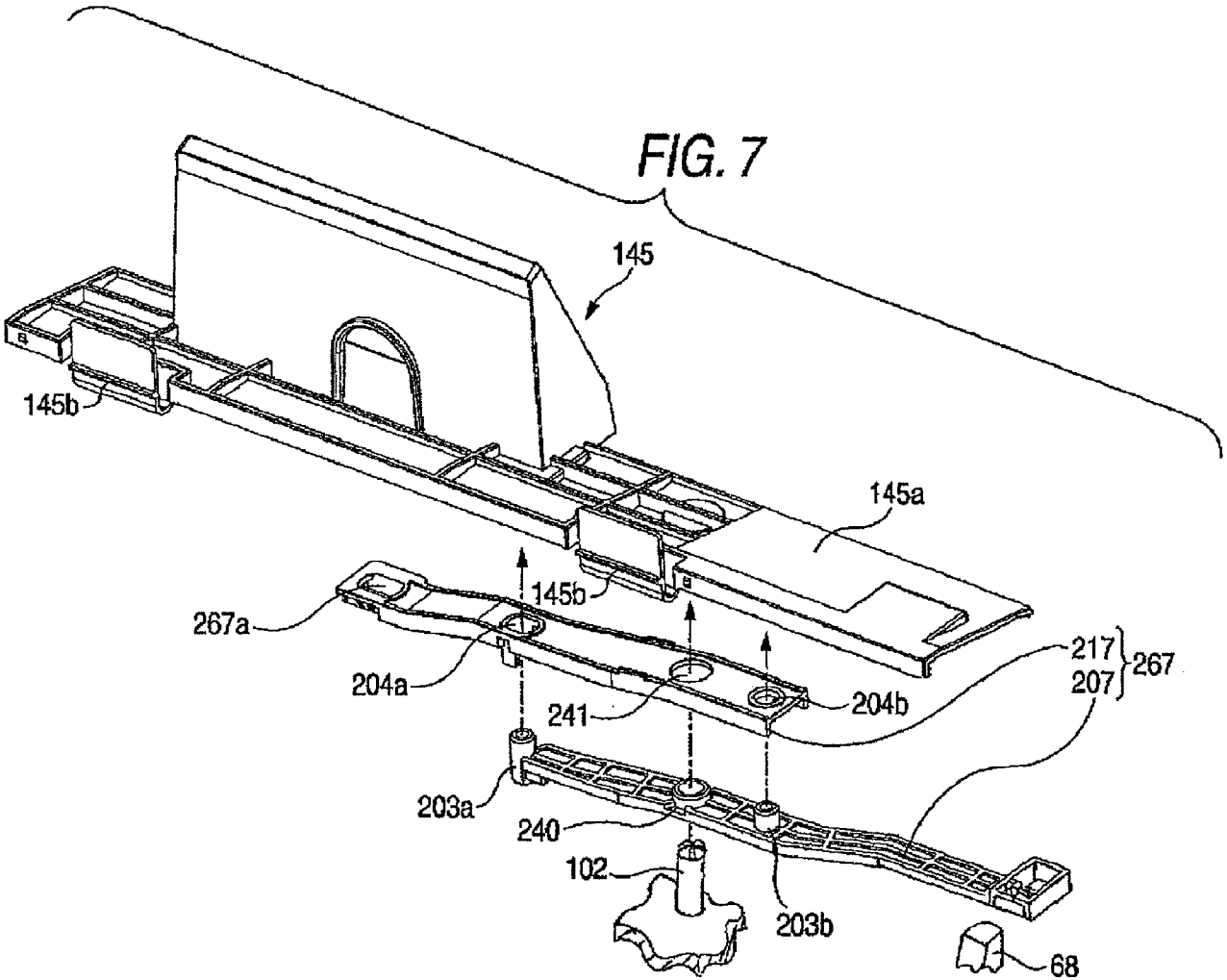
FIG. 7 is a perspective view of the major parts of an arm, etc., according to second illustrative aspect of the present invention.
Figure 8:
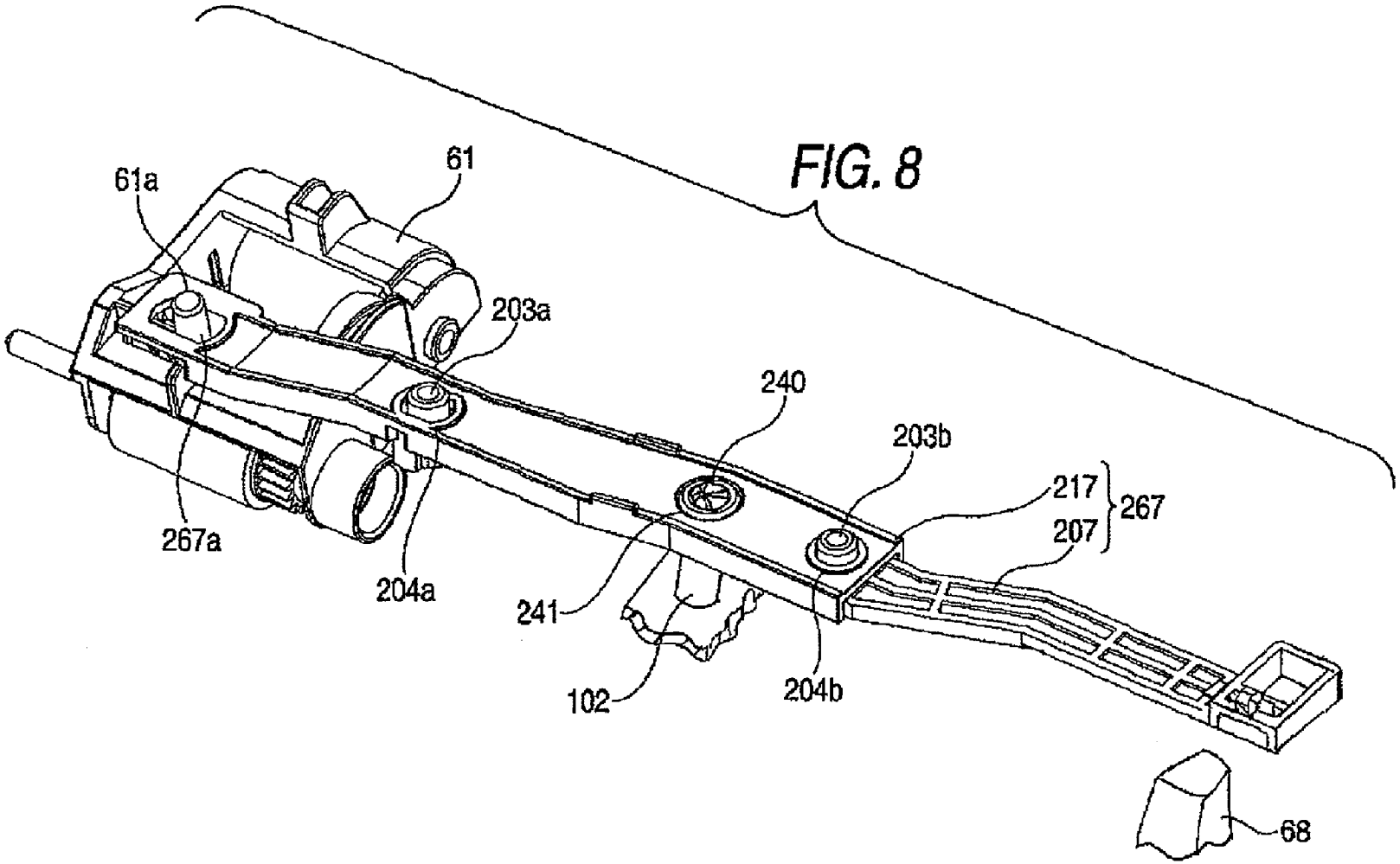
FIG. 8 is a disassembled perspective view showing a state where the first arm and the second arm are made integral with each other.

A description is given of second illustrative aspect of the present invention with reference to FIG. 7 through FIG. 13. Since the vertical drive mechanism 60 of the feed roller 51 has almost the same configuration as that in first illustrative aspect, a detailed description thereof is omitted. FIG. 7 and FIG. 8 are perspective views of the major parts of the arm 267, etc., in second illustrative aspect. The following description is based on these drawings.

The first arm 207 includes two arm bosses 203*a* and 203*b* in the axial direction of the separation roller 52. A rotation center boss 240, with which the arm pivot 102 disposed at the apparatus main body intervenes, is provided between the arm bosses 203*a* and 203*b*.

The second arm 217 includes two arm holes 204*a* and 204*b*. A rotation center hole 241 is provided between the two arm holes 204*a* and 204*b*. By the two arm bosses 203*a* and 203*b* of the first arm 207 being fitted in the armholes 204*a* and 204*b* of the second arm (since the rotation center boss 240 is smaller than the rotation center hole 241, idle fitting is brought about), these components can be positioned with respect to each other. Accordingly, the first arm 207 and the second arm 217 are made integral with each other, and the first arm 207 and the second arm 217 are able to swing integrally with each other centering around the arm pivot 102. Further, the arm covering member 145 is provided so as to be opposed to the upper surfaces of the first arm 207 and the second arm 217, which are positioned to each other. The arm covering member 145 comprises a pressing plate portion 145*a* opposed to the upper surface of the arm 67 and a resilient locking claw 145*b* engaged with a locking step portion 245 disposed at the sheet feeder main body.

Figure 9:
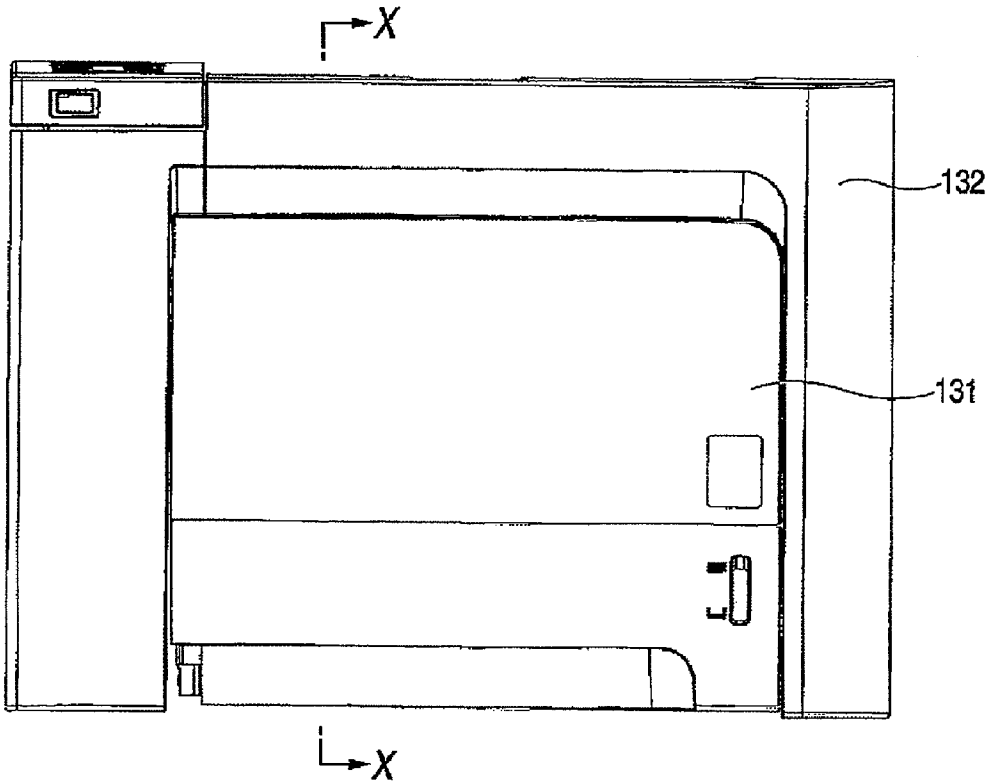
FIG. 9 is a front elevational view of a laser printer according to second illustrative aspect of the present invention.
Figure 10:
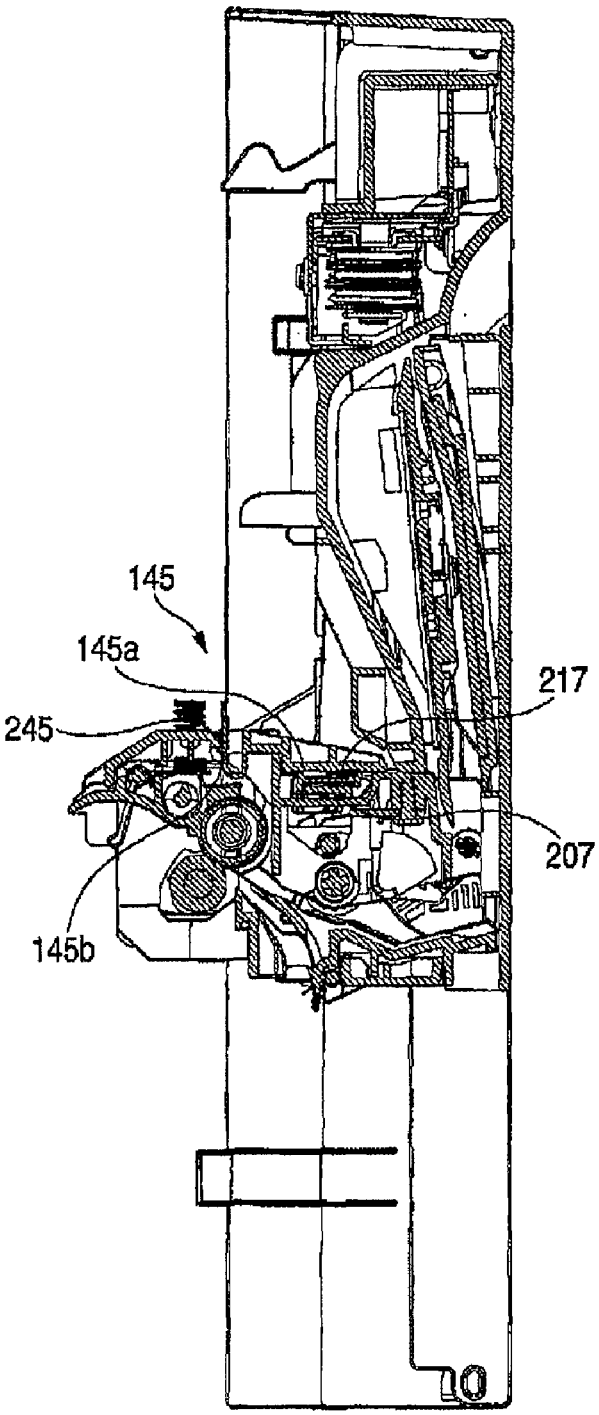
FIG. 10 is an enlarged sectional view taken along the line X-X in FIG. 9.

FIG. 9 is a view showing the printer 1 observed from the front side. FIG. 10 is an enlarged sectional view taken along the line X-X in FIG. 9. In FIG. 9, the front side cover 132 of the printer 1 which is an image forming apparatus comprises a sheet feeding cover 131 concurrently used as the MP tray 41. The cover turning shaft axially supports the lower end portion of the sheet feeding cover 131, and the sheet feeding cover 131 can be opened and closed to the near side direction in the drawing around the cover turning shaft.

As shown in FIG. 10, the second arm 217 is provided on the upper surface of the first arm 207, and the pressing plate portion 145*a*, which is a part of the arm covering member 145, faces the upper surface of the second arm 217. The arm covering member 145 is prevented from being floated upward by the resilient locking claw 145*b* being engaged with the locking step portion 245 of the sheet feeder main body, whereby the second arm 217 is also prevented from being floated upward so that it does not come off from the first arm 207.

Figure 11:
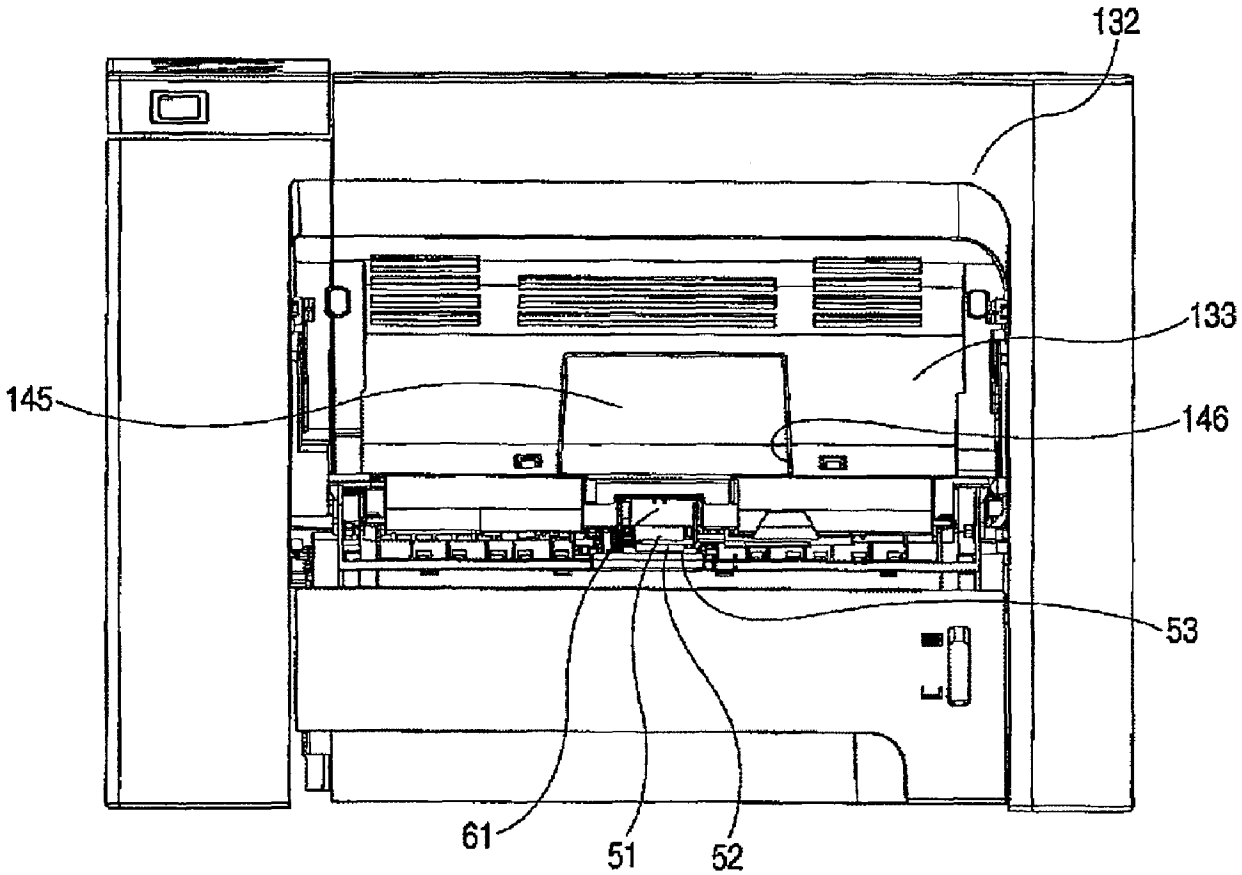
FIG. 11 is a view showing the MP sheet feeding mechanism observed from upside with the sheet feeding cover removed.

FIG. 11 shows a state where the MP sheet feeding mechanism 42 is observed from its front side with the sheet feeding cover 131 open (however, illustration of the sheet feeding cover 131 is omitted). If the sheet feeding cover 131 is turned to near side in the drawing, the MP sheet feeding mechanism 42 become a state in which the MP sheet feeding mechanism 42 may be used. The front cover 133 of the sheet feeder is located at the position opposed to the sheet feeding cover 131 and is a part of the front cover 132 to enclose the front side of the printer 1. The arm covering member 145 is a part of the front cover 133. The MP sheet feeding mechanism 42 comprises a feed roller 51, a separation roller 52, and a separation pad 53 pressed in a state where it is opposed to the separation roller 53. Sheets 3 are fed by rotation of the feed roller 51. After the sheets 3 are nipped between the separation roller 52 and the separation pad 53, the sheets 3 are separated one by one by cooperation thereof and are fed. A fed sheet 3 is conveyed to the registration roller 15 through the conveying path 54.

Figure 12:
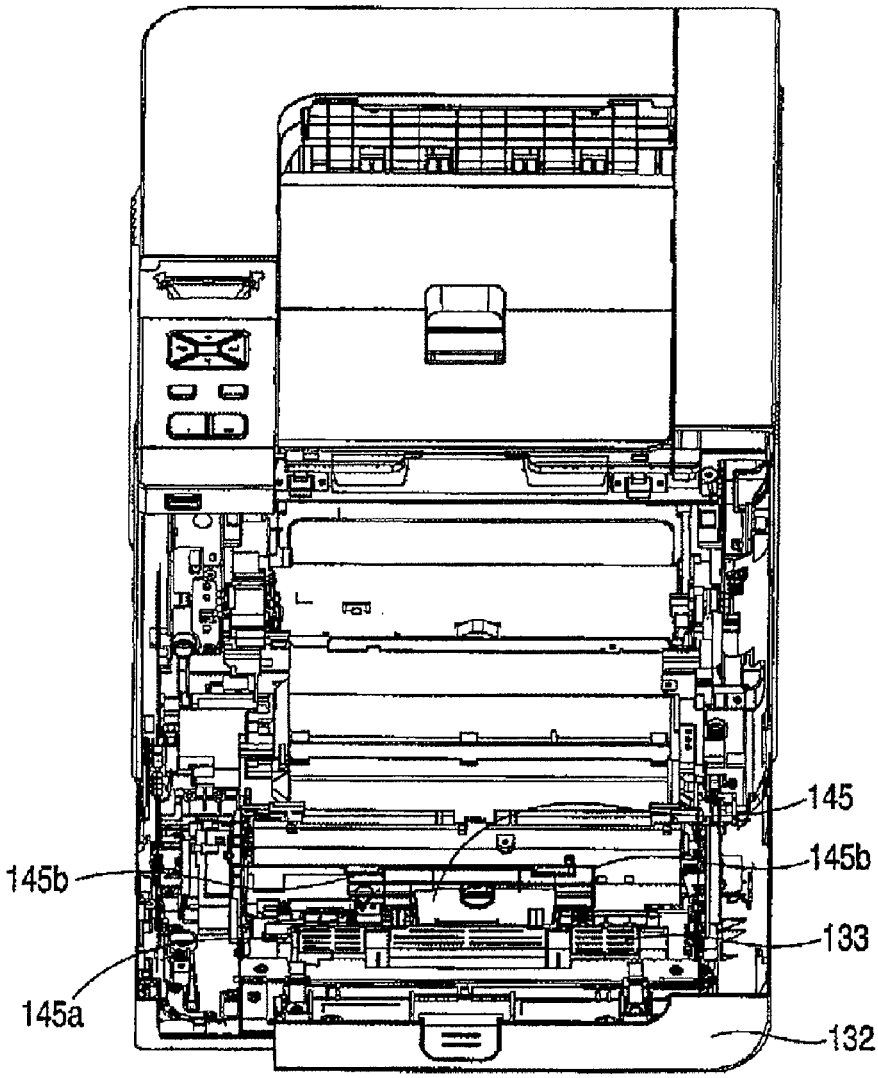
FIG. 12 is a view showing the interior of a printer, which is observed from the upside with the front cover opened.

As shown in FIG. 12, the front side cover 132 of the printer 1 can be opened to near side of the drawing integrally with the front cover 133 of the sheet feeder together with the MP sheet feeding mechanism 42. The arm covering member 145 has a pressing plate portion 145*a* at the drive source side (the left direction in the drawing), the drive source has a power for swinging the first arm 207 and the second arm 217. By operating two resilient locking claws 145*b* provided in the arm covering member 145 and releasing the engagement of the sheet feeder main body with the locking step portion 245, the entirety of the arm covering member 145 can be removed from the sheet feeder main body.

Figure 13:
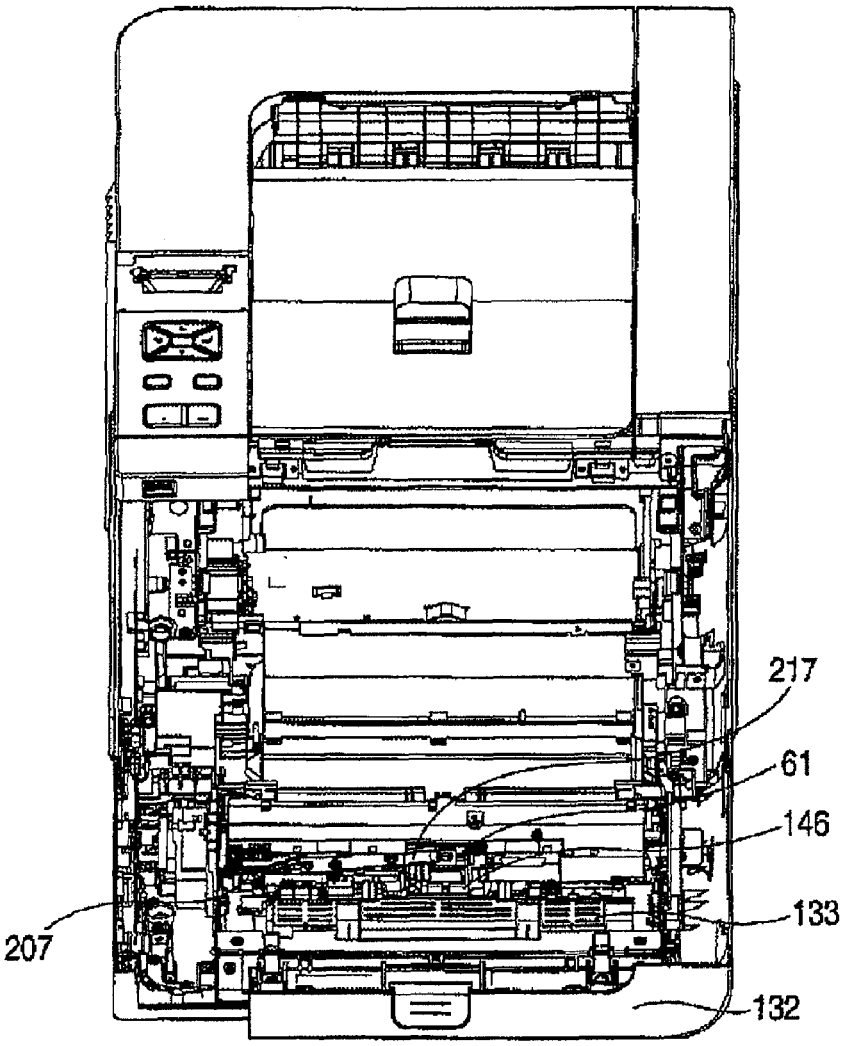
FIG. 13 is a view showing a state where the arm covering member is removed in FIG. 12.

FIG. 13 shows a state where the arm covering member 145 is removed from the sheet feeder main body, which is a view showing the inside of the apparatus main body observed from the upside with the front cover 133 opened.

When the arm covering member 145 is removed, the first arm 207 and the second arm 217 are exposed and can be observed. The first arm 207 is mounted swingably centering around the arm pivot 102 in a state where the first arm 207 is prevented from coming off upwards by the arm pivot 102 being inserted into the hole provided at the center of the rotation centering boss 204 and an outwardly-opening resilient locking claw disposed at the distal end of the arm pivot 102 being engaged with the upper end surface of the rotation center boss 240.

On the other hand, since the second arm 217 is fitted in only the upper side of the first arm 207, it can be easily removed. Therefore, the supporting member 61 that supports the feed roller 51 and the separation roller 52 can be simply removed as the roller unit.

Since the arm covering member 145 is constructed as a part of the front cover 133, an opening 146 is brought about at the position from which the arm covering member 145 is removed, when the arm covering member 145 is removed from the printer 1. Through the opening 146, it becomes easy to access from the outside of the printer 1 to the inside thereof, wherein it becomes possible to replace the rollers not only through the inside of the printer 1 but also from the outside thereof through the opening 146.

In addition, in first illustrative aspect described above, although two pairs of the arm boss 103*a* and arm hole 104*a* and the arm boss 103*b* and arm hole 104*b* are employed as the positioning portions, it is not necessary that two positioning portions are provided, wherein three or more positioning portions may be employed. Furthermore, in first illustrative aspect, although the first arm 107 comprises the arm bosses 103*a* and 103*b*, and the second arm 117 comprises the arm holes 104*a* and 104*b*, the arms are not limited thereto. For example, the first arm 107 may be comprises the holes 104*a* and 104*b*, and the second arm 117 may comprises the arm bosses 103*a* and 103*b*.

Further, the first arm 107 may comprise the arm boss 103*a* and the arm hole 104*b*, and the second arm may comprise the arm hole 104*a* and the arm boss 103*b*. Further, the first arm 107 may comprise the arm hole 104*a* and the arm boss 103*b*, and the second arm 117 may comprise the arm boss 103*a* and the arm hole 104*b*.

Still further, with respect to the first arm 207 and the second arm 217 according to second illustrative aspect, they may be constructed as in the modified versions of first illustrative aspect.

Figure 14:
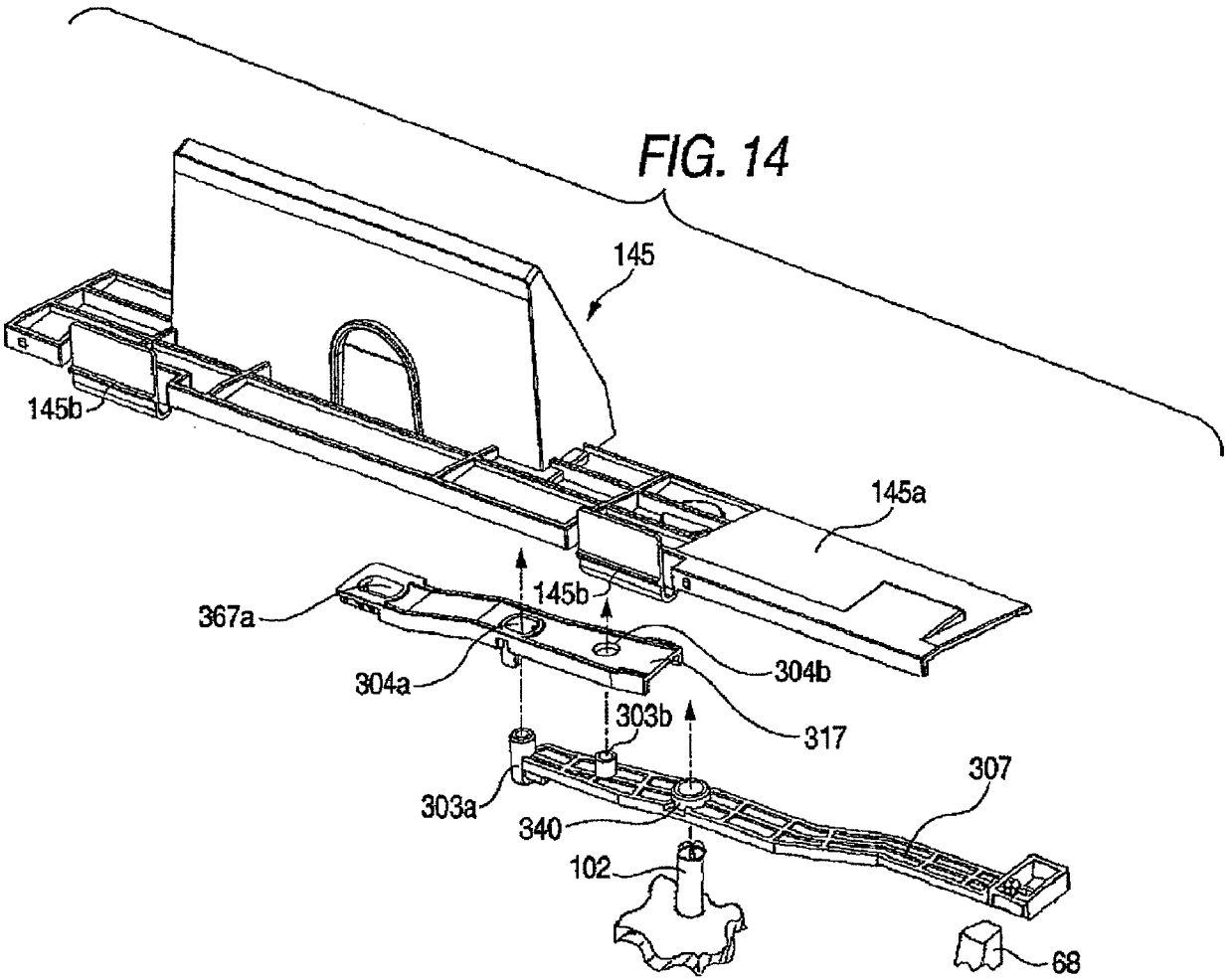
FIG. 14 is a perspective view of the major parts of an arm, etc., according to exemplary illustrative aspect of the present invention.
Figure 15:
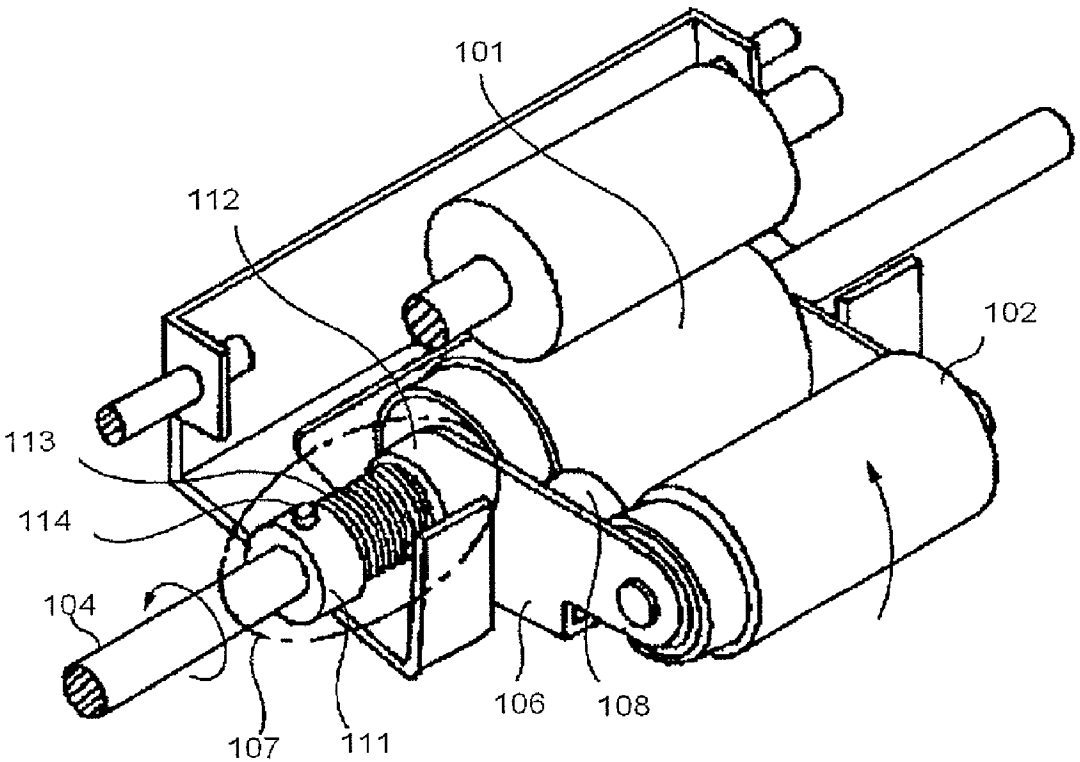
FIG. 15 is a perspective view showing a vertical drive mechanism of a related art feed roller.

In addition, as shown in FIG. 14, the first arm and the second arm may be constructed as follows.

The first arm 307 includes two arm bosses 303*a* and 303*b* in the axial direction of the separation roller 52. A rotation center boss 340, with which the arm pivot 102 disposed at the apparatus main body intervenes, is disposed on the first arm 307. The arm bosses 303*b* are disposed between the arm boss 203*a* and the rotation center boss 340.

The second arm 317 includes two arm holes 304*a* and 304*b*. By the two arm bosses 303*a* and 303*b* of the first arm 207 being fitted in the arm holes 304*a* and 304*b* of the second arm, these components can be positioned with respect to each other. Accordingly, the first arm 307 and the second arm 317 are made integral with each other, and the first arm 307 and the second arm 317 are able to swing integrally with each other centering around the arm pivot 102. Further, the arm covering member 145 is provided so as to be opposed to the upper surfaces of the first arm 307 and the second arm 317, which are positioned to each other.

Also, the first arm may be connected to the second arm via an intermediate material, for example, a third arm that connects the first arm and the second arm.

As shown in FIG. 7 and FIG. 14, since at least two positioning portions are provided for the first arm and the second arm with some spacing, it is possible to reduce play produced between the first arm and the second arm. As shown in FIG. 7 and FIG. 8, since the arm pivot is provided between the respective positioning portions, operation of integral swinging of the first arm and the second arm can be stabilized.

According to the above illustrative aspects, since the boss provided at one arm can be fitted in the hole provided at the other arm, it is possible to easily and securely position both the arms.

According to the above illustrative aspects, since the first arm and the second arm are covered by a arm covering member, it is not necessary to fix the first arm and the second arm, wherein it is possible to securely prevent the second arm from coming off from the first arm when swinging.

According to the illustrative aspects, since the arm covering member is composed as a part of the cover to enclose the main frame of the image forming apparatus, it is possible to make access the interior through an opening from which the arm covering member is removed, in a state where the arm covering member is removed when replacing the rollers.

According to the above illustrative aspects, it is possible to compose an image forming apparatus capable of easily carrying out replacement of the feed roller and the separation roller.

What is claimed is:

1. A sheet feeder comprising:

a feed roller which feeds sheet by rotating in contact with the sheet;

a separation roller which is disposed at a downstream side of a sheet feeding direction;

a supporting member which supports the feed roller and the separation roller, the supporting member is supported so as to be swingable around the rotation axis of the separation roller;

a drive source which drives the supporting member so as to swing;

an arm pivot which is disposed between the drive source and the supporting member;

a first arm which is disposed at a side of the drive source; and a second arm which is disposed at a side of the supporting member, the second arm is able to be separated from the first arm;

wherein the first arm and the second arm are integrally swung around the arm pivot by the drive source, thereby the supporting member swinging, and wherein the first arm and the second arm each have a positioning portion that positions the other, respectively.

2. The sheet feeder according to claim 1, wherein the first arm and the second arm have at least two positioning portions that position each other respectively, and the positioning portions are disposed in positions between which the arm pivot is placed, in the direction of the rotation axis of the separation roller.

3. The sheet feeder according to claim 2, wherein the positioning portions are, respectively, a hole provided at any one of the first arm and the second arm, and a boss provided at the other one thereof.

4. The sheet feeder according to claim 1, further comprising;

an arm covering member which is disposed at a position which is on a extending direction for removing the second arm from the first arm, the arm covering member being removably positioned in contact with or in the vicinity of the upper surface of the second arm.

5. An image forming apparatus which including a sheet feeder and a cover for covering a main frame of the image forming apparatus, wherein:

the sheet feeder comprising;

a feed roller which feeds sheet by rotating in contact with the sheet;

a separation roller which is disposed at a downstream side of a sheet feeding direction;

a supporting member which supports the feed roller and the separation roller, the supporting member is supported so as to be swingable around the rotation axis of the separation roller;

a drive source which drives the supporting member so as to swing;

an arm pivot which is disposed between the drive source and the supporting member;

a first arm which is disposed at a side of the drive source;

a second arm which is disposed at a side of the supporting member, the second arm is able to be separated from the first arm; and an arm covering member which is disposed at a position which is on a extending direction for removing the second arm from the first arm, the arm covering member is provided so as to move to a position in contact with or in the vicinity of the upper surface of the second arm and a position apart from the upper surface of the second arm;

wherein the first arm and the second arm are integrally swung around the arm pivot by the drive source, thereby the supporting member swinging; and the arm covering member is a part of the cover of the main frame, the arm covering member being provided so as to be movable between a position in which the arm covering member is in contact with or in the vicinity of the upper surface of the second arm and a position apart from the upper surface of the second arm in response to an opening and closing motion of the cover of the main frame.

6. An image forming apparatus according to claim 5, wherein the first arm and the second arm have at least two positioning portions that position each other respectively, and the positioning portions are disposed in positions between which the arm pivot is placed, in the direction of the rotation axis of the separation roller.

7. The image forming apparatus according to claim 6, wherein the positioning portions are, respectively, a hole provided at any one of the first arm and the second arm, and a boss provided at the other one thereof.

* * * * *